United States Patent [19]

Poehner et al.

[11] Patent Number: 4,724,555

[45] Date of Patent: Feb. 16, 1988

[54] HOSPITAL BED FOOTBOARD

[75] Inventors: Michael E. Poehner, West Harrison, Ind.; Jeffrey R. Welling, Cincinnati, Ohio

[73] Assignee: Hill-Rom Company, Inc., Batesville, Ind.

[21] Appl. No.: 28,819

[22] Filed: Mar. 20, 1987

[51] Int. Cl.[4] ..... A61G 7/06

[52] U.S. Cl. ..... 5/80; 5/183; 5/280; 5/507

[58] Field of Search ..... 5/60, 80, 181, 183, 5/184, 202, 280, 424, 429, 430, 505, 507

[56] References Cited

U.S. PATENT DOCUMENTS

| | | | |
|---|---|---|---|
| 541,339 | 6/1895 | Thompson . | |
| 1,347,271 | 6/1920 | Hartman | 5/507 |
| 1,359,623 | 11/1920 | Sadlick | 5/507 |
| 1,694,095 | 12/1928 | Du Moulin . | |
| 1,719,614 | 8/1929 | McIntosh . | |
| 2,483,920 | 10/1949 | McLean et al. . | |
| 2,594,926 | 4/1952 | Hoffman | 5/430 |
| 2,701,374 | 2/1955 | Hillenbrand et al. | 5/280 X |
| 2,709,818 | 6/1955 | Freese . | |
| 2,732,568 | 1/1956 | Kirkwood, Jr. . | |
| 2,739,319 | 3/1956 | Keller . | |
| 2,750,605 | 6/1956 | Blevins | 5/430 |
| 3,195,518 | 8/1965 | Boyer . | |
| 3,564,627 | 2/1971 | Allard et al. . | |
| 3,866,251 | 2/1975 | Pounds . | |
| 3,893,197 | 8/1975 | Ricke . | |
| 4,381,572 | 5/1983 | Thumberger . | |
| 4,404,698 | 9/1983 | Koncelik et al. . | |

*Primary Examiner*—Alexander Grosz
*Assistant Examiner*—Michael F. Trettel
*Attorney, Agent, or Firm*—Steve M. McLary; F. Kristen Koepcke

[57] ABSTRACT

A hospital bed footboard is provided which can be moved from the normal, vertical position of a bed footboard to a horizontal position overlying the bed. The support for the footboard in the overbed position is of a fully cantilevered nature so no impediment is placed to approaching the patient from the sides of the bed, nor is the overall width of the bed increased. The footboard when positioned over the bed can serve as a shelf for holding monitoring and life support devices during patient transport.

8 Claims, 18 Drawing Figures

HOSPITAL BED FOOTBOARD

BACKGROUND OF THE INVENTION

The present invention relates to a footboard assembly for a hospital bed. In the context of this invention, the term hospital bed should be viewed as a generic term which encompasses all types of patient support surfaces. This improved footboard may be positioned over the patient (or the bed mattress) to provide a shelf or work surface. This newly provided space is of substantial help in patient transfer situations.

The transfer of a patient, particularly a critically ill patient, within a hospital is a difficult process. The equipment required for transport may include portable monitors, I.V. pumps, and defibrillators. Lacking a good location for all of this equipment, it is often placed on the bed with the patient or several medical staff personnel must move with the patient to carry or push the needed equipment. Either situation is clearly undesirable.

The present invention provides a shelf over the bed. This location over the bed provides space for emergency and other equipment during patient transport in the bed while still not increasing the overall dimensions of the bed. This is important for maneuvering through tight hospital doors or corridors and in elevators. If a shelf were added that extended beyond the bed, the combination of bed and shelf might not fit in an elevator. Thus, a problem in equipment movement has been solved while not creating another problem by making the overall dimension of the bed longer.

U.S. Pat. No. 3,564,627 illustrates a footboard and a headboard for a hospital bed which foot and headboards are movable from one position to another. In particular, FIG. 3 of this reference illustrates how the footboard may be pivoted from a vertical to a horizontal position. However, this increases the overall dimension of the bed and is not positioned over the bed itself.

U.S. Pat. Nos. 1,719,614; 2,483,920; and 2,709,818 all illustrate a similar concept. These patents all teach a form of overbed patient table which can pivot from a position over a head or footboard to a position over a bed. However, these are all separate devices, not a head or footboard per se, all require attachment to the side of the bed which can interfere with medical procedure and are not supported in a cantilever manner from the foot of the bed.

U.S. Pat. Nos. 3,195,151; 3,893,197, and 4,381,572 all teach some form of hospital bed footboard that is movable. These references all attach the footboard to the side rails or longitudinal support members and do not support the footboard in a cantilever manner from the foot of the bed. Thus, the side of the bed is cluttered with support devices in the case of all of these references.

U.S. Pat. Nos. 1,694,095; 2,732,568; and 3,866,251 all teach an attachment (tray or foot rest) to the footboard of a hospital bed. These devices all can be pivoted to extend over the bed surface. However, they are attachments to a footboard and are not the footboard itself, as claimed by Applicants. Furthermore, it is not at all clear that the structures shown in U.S. Pat. Nos. 1,694,095 and 3,866,251 could be positioned perpendicular to the headboard and function as a tray at all. There is certainly no hint of any such function in these patents.

U.S. Pat. No. 4,404,698 teaches a hospital bed in which the footboard is configured to hold a tray. The tray can be removed from the footboard and positioned over the bed.

U.S. Pat. Nos. 541,339 and 2,739,319 teach bed footboards which contain trays that may be extended from the footboard. However, these are auxiliary devices, not the footboard per se, and extend away from the bed, not over the bed.

SUMMARY OF THE INVENTION

This invention is an improved form of footboard for a hospital bed. The hospital bed is of the type which has support members which are tied together by to form a platform. The platform can serve to hold a patient supporting mattress. The bed has a headboard attached to the head end. A footboard is attached to the foot end of the bed. The footboard is attached by a means that allows moving the footboard from a first position facing the headboard to a second position that is generally perpendicular to the headboard and overlying the mattress. The attachment means provides a cantilevered support for the footboard in the second position, thus leaving the sides of the bed completely free of any obstruction resulting from positioning the headboard over the mattress.

DETAILED DESCRIPTION OF THE INVENTION

Figure 1:
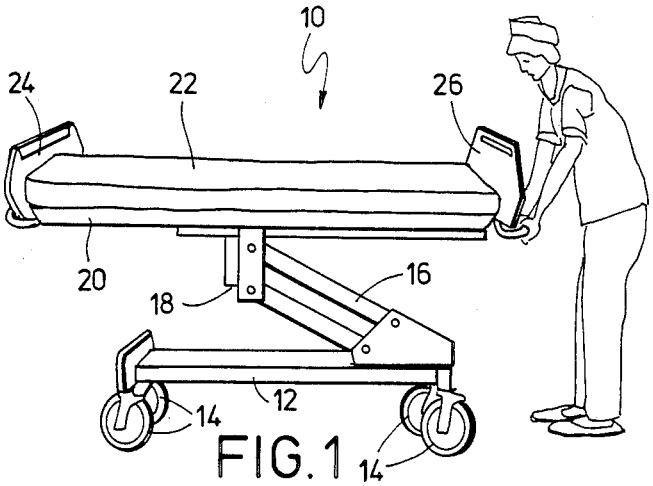
FIG. 1 is a perspective view of the present invention in a stored position.
Figure 2:
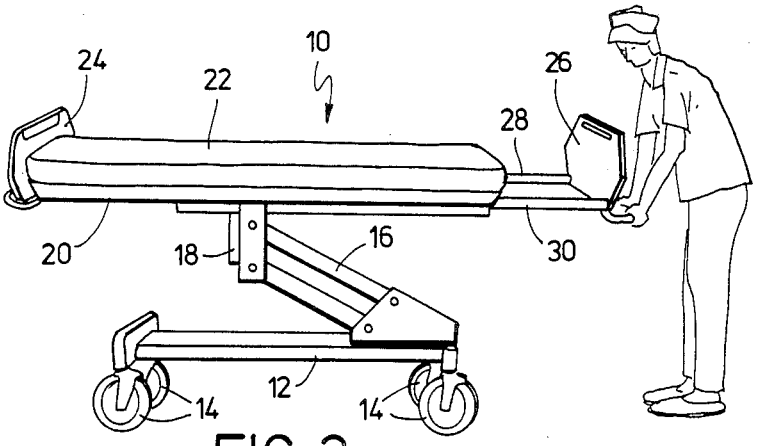
FIG. 2 is a perspective view of the present invention in an intermediate position.
Figure 3:
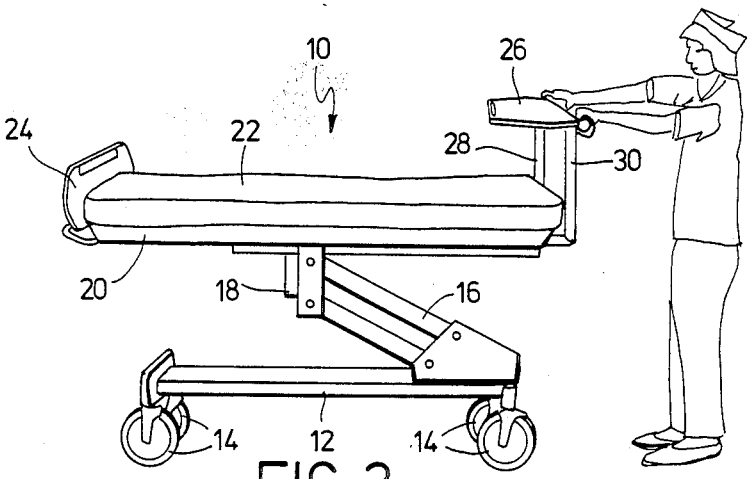
FIG. 3 is a perspective view of the present invention positioned over a patient bed.

FIGS. 1, 2 and 3 illustrate the operation of the present invention. A hospital bed 10 is made up of a number of components and may be of several different styles. For ease of illustration, the bed 10 that is illustrated in this case is of the general type sold by the Hill-Rom Company, Inc. and designated as the Century CC bed. This bed includes a lower base support unit 12 which has mounted on it a plurality of casters 14 to provide mobility for the bed 10. The base 12 carries the basic operating mechanisms for the entire bed 10 and has extending from it a lift arm 16 which is pivotally mounted to the base 12 and is also pivotally mounted to a bracket 18 at its end remote from the base 12. Attached to the bracket 18 is a patient support surface which is made up of several components. The patient support suface has as a general rule, a pair of spaced apart longitudinal support members 20, only one of which is visible in FIGS. 1 through 3, which are then tied together by transverse members, which are not visible in these views, to form a substantially rectangular and rigid structure which is mounted to the bracket 18. The support members 20 in this case are hollow beam members of a box beam type construction. They could be hollow tubular members or channel type members as well. The structure made of the longitudinal support members and their corresponding transverse members forms a platform upon which a conventional articulating mechanism may be mounted to move a mattress 22 which is mounted upon the articulating mechanism. The articulating mechanism forms no part of this invention and is thus not shown detail. Some beds may not include the articulating mechanism and the mattress 22 may rest directly upon the platform. The bed 10 also has attached to the support members 20 a headboard 24 and a footboard 26. In conventional practice, the headboard 24 and footboard 26 are used as a matter of convenience to help restrain patients within the bed and to define the limits of the bed's surface. The headboard 24 and the footboard 26 are mounted adjacent to the longitudinal support members 20 in such a manner as to be readily removable, in the case of the headboard in order to give access to the head of the patient for emergency procedures that may be required. Thus the configuration of the bed 10 shown in FIG. 1 is that in which it would normally be in a patient room, with the headboard 24 and the footboard 26 in proximity to the mattress 22. Certain clearances between the mattress 22 and the headboard 24 and footboard 26 are dictated by various codes, but the general position is as shown in FIG. 1 in close proximity to the mattress 22. Both the headboard 24 and the footboard 26 are usually of a width sufficient to extend across the transverse dimension of the mattress 22.

FIG. 2 illustrates the use of the present invention to pull the footboard 26 away from proximity to the mattress 22. Hospital personnel can extend the footboard 26 away from the mattress 22 and the footboard 26 is mounted on longitudinally extendable runners 28 and 30 which extend outward from the longitudinal support members 20. As will be shown in more detail in following drawings, the footboard 26 in the case of the present invention is actually mounted on the runners 28 and 30 as opposed to being mounted on the support members 20 as is more conventionally the case.

FIG. 3 shows the footboard 26 in a position extending over the mattress 22. It is this position which it is believed gives a significant advantage to this particular mechanism in allowing the footboard 26 to be positioned over the mattress 22. This is a position in which the footboard 26 is supported in a cantilevered manner. This leaves both sides of the bed 10 free of obstructions.

Figure 4:
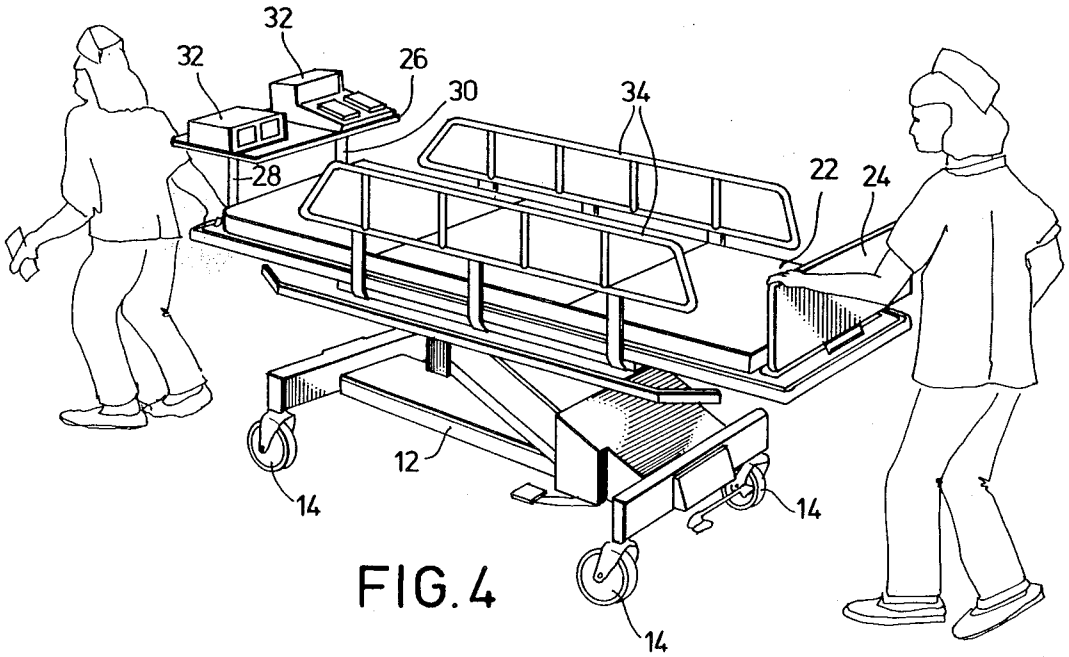
FIG. 4 is a perspective view of the present invention being used as an equipment shelf.

As shown in FIG. 4, this positioning of the footboard 26 over the mattress 22 allows various forms of life support and monitoring equipment 32 to be placed on the footboard 26 during the transport of a critically ill patient in the hospital. In the prior art, these devices such as life support devices and monitors were placed on the mattress 22 and the patient's legs were displaced to make room for these devices. Clearly, this is an undesirable and dangerous situation and in some cases created significant discomfort for the patient and inconvenience for the medical staff. Thus, the ability of the footboard 26 to be positioned over the mattress 22 provides a significant advantage in terms of an available work space. It might also be noted that in FIG. 4 the bed 10 is shown with patient guard rails 34 in place as would normally be the case during the transport of a patient in the bed 10.

Figure 5A:
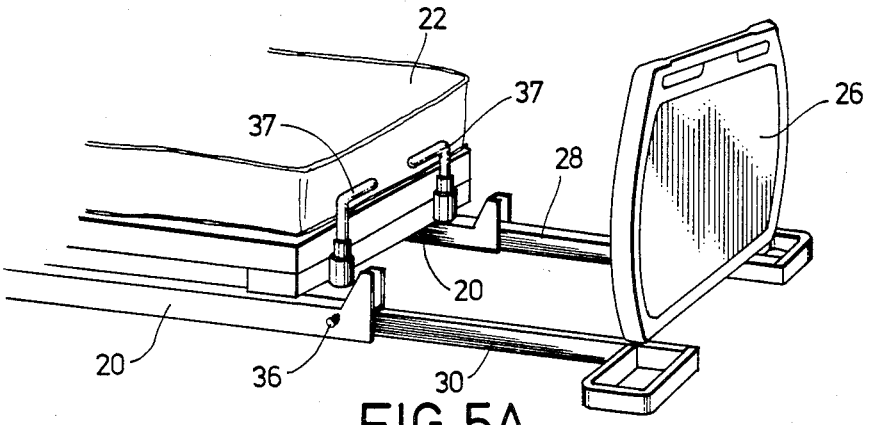
FIGS. 5A, 5B and 5C are a series of partial side elevational views showing the present invention in use as a bed length extender.
Figure 5B:
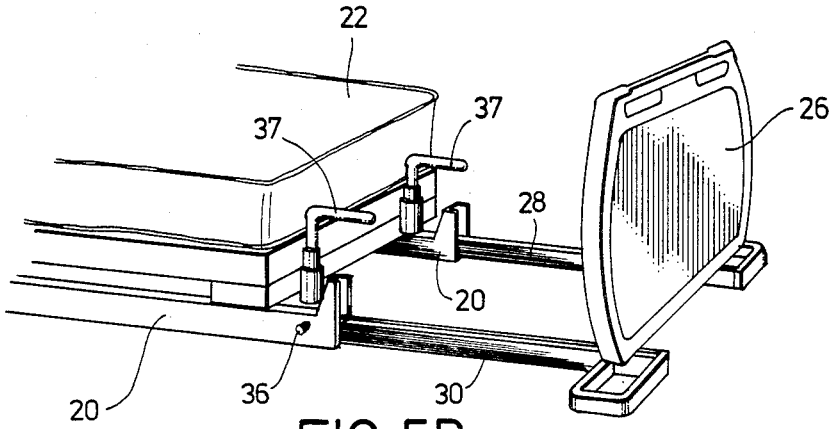
Figure 5C:
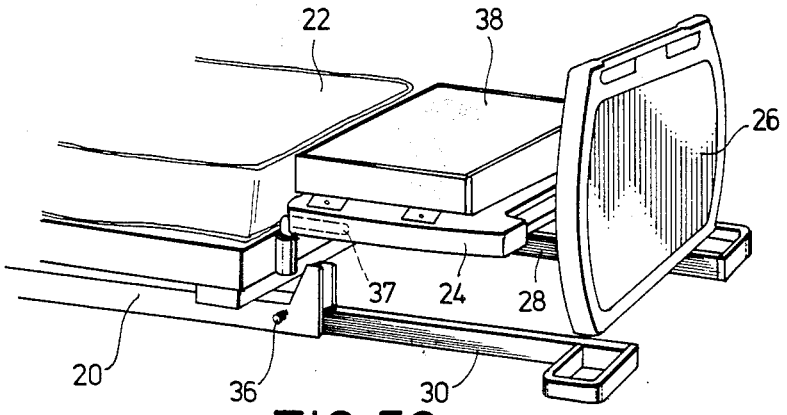

As illustrated in FIGS. 5A, 5B, and 5C, the present invention can also be used as an extender for the bed 10 to provide extra length for taller than average patients. In this situation, the runners 28 and 30 are extended as if the footboard 26 were to be pivoted into the position shown in FIG. 3. However, rather than doing this, locking pins 36 may be inserted in an opening in the runners 28 and 30 to lock them in the extended position shown in FIG. 5A. FIG. 5A also shows stop pins 37, which are generally "L" shaped. The stop pins 37 are normally turned toward the mattress 22 and serve to prevent its movement. The stop pins 37 are movable in their mountings and can be pivoted to the position shown in FIG. 5B. At this point, the headboard 24 may be removed from its normal location and inserted over the stop pins 37 as shown in FIG. 5C. A pillow 38 is then placed on top of the headboard 24 to bring the overall level of the extended portion up to the level of the mattress 22. After this has been done, the runners 28 and 30 are pushed in slightly until locking pins 36 may engage the holes in the runners 28 and 30. The locking pins 36 are spring loaded such that they normally will not engage the runners 28 and 30. This is done because the usual reason for extending the runners 28 and 30 is to pivot the footboard 26 over the bed 10. The use of the runner 28 and 30 as a bed extender is an unusual situation and thus requires action to overcome the normal bias of the locking pins 36.

Figure 6:
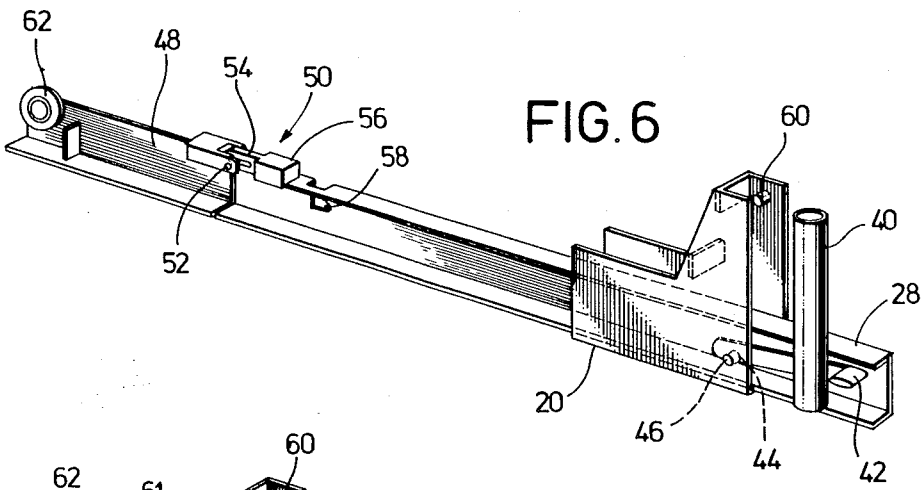
FIG. 6 is a fragmentary perspective view, partially cut away, illustrating the operating mechanism of the present invention.
Figure 7:
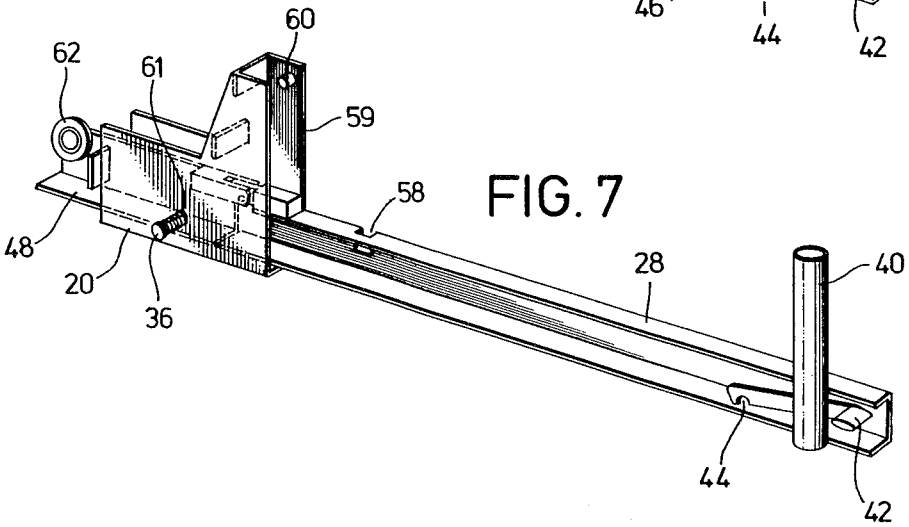
FIG. 7 is a view similar to FIG. 6 illustrating the extension of the runner of the present invention.
Figure 8:
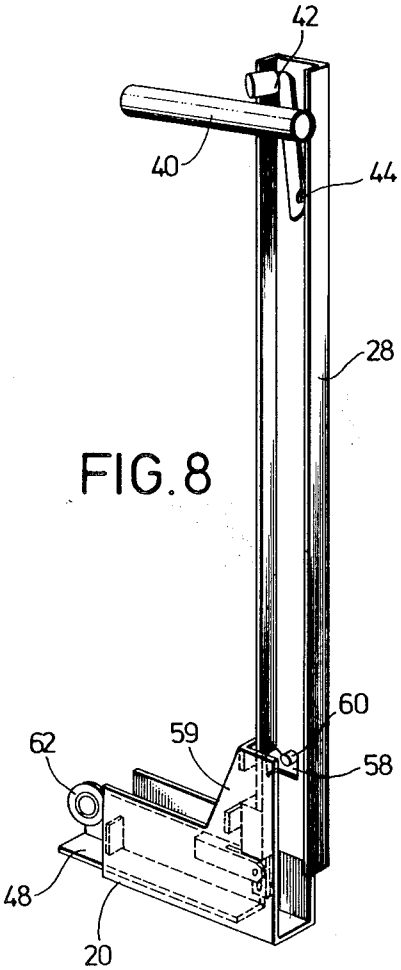
FIG. 8 is a view similar to FIG. 6 illustrating the 90° pivot of the runner of the present invention.

FIGS. 6, 7 and 8 show a preferred embodiment of the mechanism to allow the pivoting motion of the footboard 26. It is possible to provide for this motion with more than one particular form of mechanism, and alternative embodiments will be described later. However, FIGS. 6, 7 and 8 illustrate an embodiment which is particularly favored at this time. FIG. 6 shows the configuration which exists with respect to the bed 10 as shown in FIG. 1. In this arrangement, the runner 28, which is illustrated for ease of understanding as opposed to illustrating both runners, is completely retracted within the longitudinal support member 20. FIG. 6 shows that the runner 28 carries a generally vertically extending post 40 onto which one end of the footboard 26 is inserted. The opposite side of the footboard 26 is inserted over a corresponding post 40 which is carried by the opposite runner 30. These two posts 40 then serve to secure the footboard 26 in a fixed position with respect to the runners 28 and 30. It also allows for removal of the footboard 26 to form the auxiliary support surface as illustrated in FIG. 5. The runners 28 and 30 are held in place within the longitudinal support members 20 by a latch mechanism which is made up of a latch arm 42 which is pivotally mounted to the runner 28. The latch arm 42 has a notched portion 44 which is engaged in the locked position with a pin 46 that is fixed in place in the interior of the longitudinal support member 20. It can readily been seen from FIG. 6 that the longitudinal support members 20 are generally box shaped structures which allow the runners 28 and 30 to slide in and out relative to them. As FIG. 6 illustrates, the runner 28 is connected to a rear portion 48 which stays within the support member 20 as the runner 28 is pulled out from engagement with the support member 20. The rear portion 48 determines a pre-selected and fixed extended position for the runner 28. The rear portion 48 is pivotally connected to the runner 28 through a pivot mechanism 50 that includes a pin portion 52 carried by the rear portion 48 which extends through a slot portion 54 formed in a block 56 carried by the runner 28. The runner 28 also includes a generally L-shaped cut out portion 58 whose purpose will shorty be explained. In order to extend the runner 28, the latch arm 42 is pivoted to remove the notch portion 44 from engagement with pin 46 and the footboard 26 is pulled outward away from engagement with the support members 20. This then allows the configuration as shown in FIG. 2 to be achieved. It is this configuration which is illustrated in FIG. 7 to show the details of the mechanism. The locking pin 36 and its corresponding hole 61 in runner 28 are shown only in FIG. 7 to avoid confusion. However, these elements are also present if FIGS. 6 and 8 but have been omitted in the interest of showing other elements more clearly.

In FIG. 7, the runner 28 has been fully extended, as seen in FIG. 2, but has not yet been subjected to a pivoting action. An upper pin 60 is carried by an extension 59 of the support member 20. The upper pin 60 is designed to latch the runner 28 in position once it has been pivoted to its operational position. The rear portion 48 may include guide rollers 62 which are used to facilitate smooth operation of the movement of the runners 28 and 30.

As can now be seen, in FIG. 8 the ninety degree pivoting of the runner 28 is easily achieved by simply exerting upward pressure on the footboard 26 to cause pivoting of the runner 28 about the pin 52 which is carried by the rear portion 48 and thus remains fixed. This movement allows the runner 28 to pivot around the pin 52 as it moves within the slot portion 54. The motion of the runner 28 is stopped by the vertically extending extension 59 of the support member 20. At this point, the L-shaped cut-out 58 of the runner 28 will engage the upper pin 60 carried by the longitudinal support member 20. Upon entering this L-shaped cut-out, the pin 60 will seat itself near the top of the vertical portion of the L. This then locks the runner 28 in position that is shown in FIG. 3. In order to remove the runner 28 from this position, slight upward force needs to be exerted on the footboard 26. This will allow the slot 54 to move with respect to the pin 52 and allow the pin 60 to clear the lower foot portion of the L-shaped cut-out 58. This then will allow the runner 28 to be pivoted 90 degrees back to the position shown in FIG. 2 and FIG. 7. It may then be simply reinserted to the position shown in FIGS. 1 and 6 and the latch arm 42 will once again have its notch portion 44 engaged with the pin 46. Thus, a relatively simple and straight forward mechanism is provided for the pivoting of the footboard 26 into a functional work surface positioned over the mattress 22 of the bed 10.

FIGS. 1 through 7 have illustrated a means for attaching the footboard 26 to the bed 10 in such a manner that the footboard has two possible positions. In one position, as seen in FIG. 1, the footboard 26 is in generally facing relationship to the headboard 24., they are generally parallel. In the second position, illustrated in FIG. 3, the footboard 26 is overlying the mattress 22 and is generally perpendicular to the headboard 24.

Figure 11:
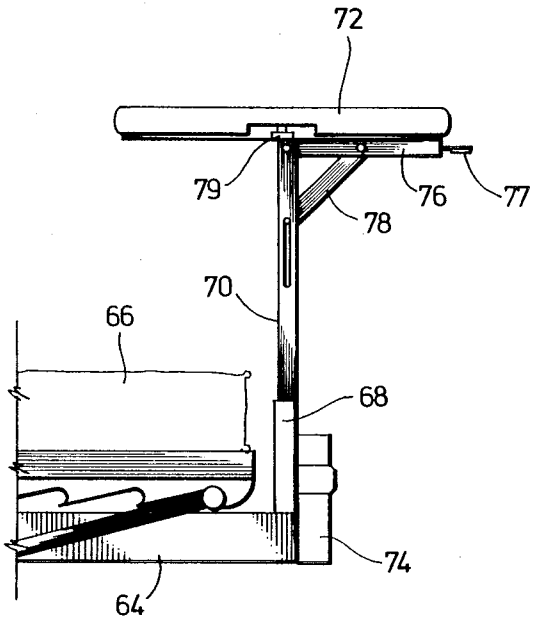
FIG. 11 is a view similar to FIG. 9 with the footboard moved over the patient support surface of the bed.
Figure 10:
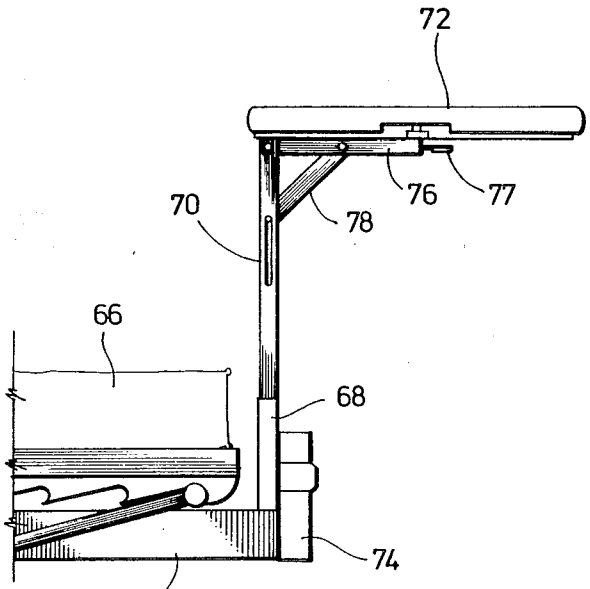
FIG. 10 is a view similar to FIG. 9 with the footboard moved 90° from its stored position.
Figure 9:
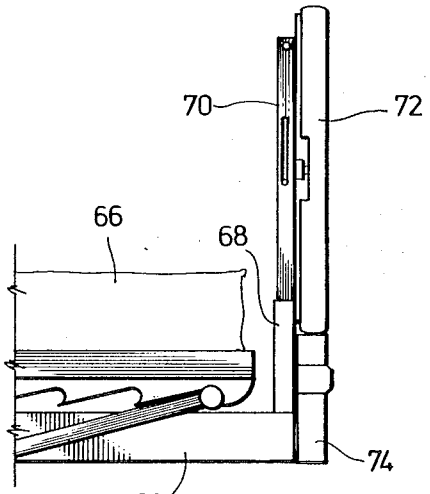
FIG. 9 is a partial side elevational view illustrating an alternative embodiment of the present inventions in a stored position.

FIGS. 9 through 11 illustrate a modified embodiment of the present invention, a modification which is particularly well adapted for retrofitting existing hospital beds. The embodiment of the invention shown in the preceding drawing figures is one which requires a design of the bed in the beginning to accommodate the mechanism that allows the footboard 26 to be pivoted into the horizontal position over the mattress 22. There are however numerous hospital beds already in the field whose functioning could be enhanced by the provision of a footboard which could be moved into position over the patient support surface similarly to that shown previously. FIG. 9 shows a hospital bed with a support frame 64 upon which is placed a mattress 66 on which a patient rests. As is conventional with such hospital beds, the support frame 64 terminates in a generally vertically upstanding post member 68 on to which a conventional footboard for the hospital bed would be placed. In this case, a vertical footboard support column 70 is slipped over the post member 68. The support column 70 carries a footboard 72 which is pivotally mounted to the support column 70 in a manner to be shown. A bumper 74 may be attached to the end of the bed. The bumper 74 along with the footboard 72 in its vertical position tend to give a complete end surface to the end of the bed.

FIG. 10 illustrates the footboard 72 raised into a horizontal position from its vertical position. The mechanism for doing this will be shown in more detail in following drawing figures. For the time being, it is sufficient to note that the footboard 72 is mounted on a slide plate 76 and held in position by a brace 78 which is moved into a locked position by the movement of the footboard 72 from its vertical position to its horizontal position. In FIG. 10 the footboard 72 extends away from the mattress 66. This configuration is one which has been known in the prior art as previously noted. However, the present invention allows the movement of the footboard 72 over the surface of the mattress 66 as shown in FIG. 11. This is done by releasing a latch lever 77 which allows the footboard 72 to move relative to the slide plate 76. In FIG. 11 the footboard 72 has been moved over the mattress 66 to provide the benefits of this configuration that had been previously discussed. In particular, this allows the positioning of various forms of life support and monitoring systems to be placed on the footboard 72 to allow transport of the patient. In addition, this position of the footboard 72 may also be used in the patient room in the event additional space is needed for monitoring or life support equipment. To return the footboard 72 to its vertical. stored position, a latch button 79 is depressed which allows movement back to the configuration of FIG. 10.

Figure 12:
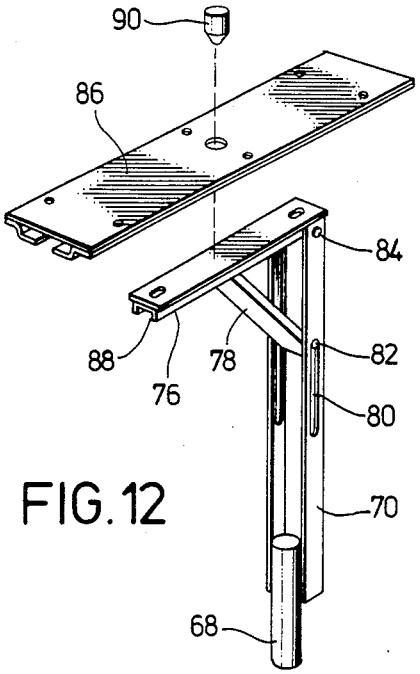
FIG. 12 is a perspective view illustrating the mechanism for moving the footboard of the embodiment of FIG. 9 from the stored position of FIG. 9 to the position of FIG. 10.

FIG. 12 shows the mechanism for raising and locking the footboard 72 into position in greater detail. It should be appreciated at this time that there are, of course, two post members 68 at the end of each bed. That is, if one will recall the earlier description of the invention, the hospital bed typically has two post members 68 at its foot to support the headboard. In this case, only one is illustrated, but both sides are substantially identical. The support column 70 as previously described slips over the post member 68 and is held in place in this manner. It may be appreciated that the footboard 72 may need to be completely removed from the end of the bed for various medical procedures, and that this particular mounting arrangement allows ready removal of the footboard 72 while still allowing positioning the footboard 72 over the mattress 66. The support column 70 includes an elongated slot 80 in which a pin 82 may freely ride. The pin 82 is attached to the brace 78 and as the footboard 72 is moved into a horizontal position, the pin 82 moves in the slot 8O allowing the brace 78 to move upward which in turn allows the slide plate 76 which is attached to the brace 78 to also move upward. Since the footboard 72 is attached to the slide plate 76, it likewise will be moved into a horizontal position. The slide plate 76 itself is pivotally mounted on pins 84 which are connected through the support column 70.

It may be seen that the footboard 72 is actually mounted to an upper slide plate 86 which has a channel portion that engages the slide plate 76. The slide plate 76 itself has a lower U shaped portion 88 to which the brace 78 is attached. The mechanism includes a locking detent pin 90 which is loaded by a spring to hold the entire mechanism in one of two preset locations. The detent pin 90 is released by the latch lever 77 or the latch button 79.

Figure 13:
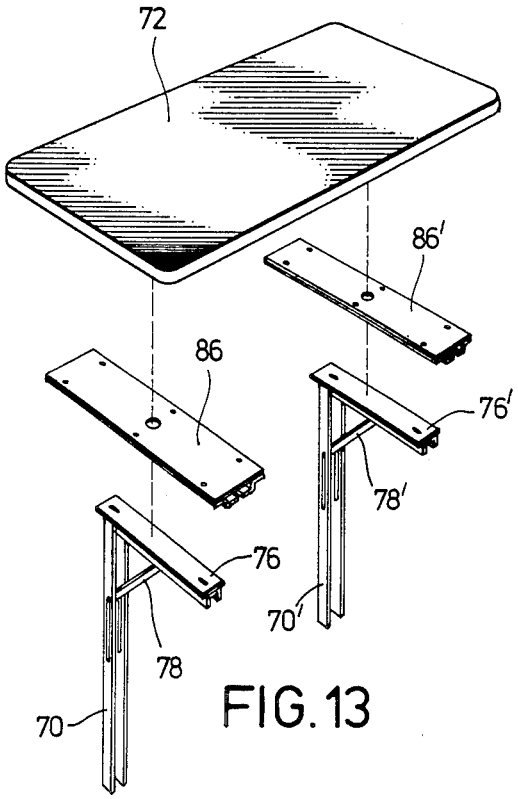
FIG. 13 is an exploded perspective view illustrating the total assembly of the footboard to the mounting system for the embodiment of FIG. 9.

FIG. 13 illustrates most clearly that there are a pair of slide plates 76 and 76' and upper slide plates 86 and 86' which support the footboard 72. This gives stability to the entire mechanism and again allows for easy removal of the entire assembly from the hospital bed should the need present itself. This exploded view of FIG. 13 illustrates the components which make up the actual operating mechanism in question.

Figure 14:
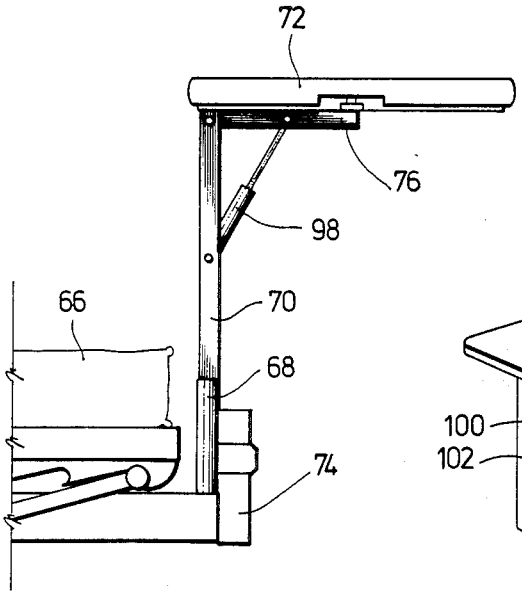
FIG. 14 is a partial side elevational view illustrating a modified form of a pivot and locking mechanism for the embodiment of FIG. 9.

FIG. 14 shows a somewhat modified embodiment of the invention just previously discussed. This is an embodiment of the invention which is primarily designed for use with an existing hospital bed. Rather than using a brace 78, this particular embodiment uses a gas cylinder 98 of a well known and conventional type. This gas cylinder simply replaces the brace 78 and its associated locking mechanism. The other parts of the device such as the slide plate 76 and the upper slide plate 86 may be identical to that previously described. This embodiment is also attached to the post member 68 through a footboard support column 70 as previously shown.

Figure 15:
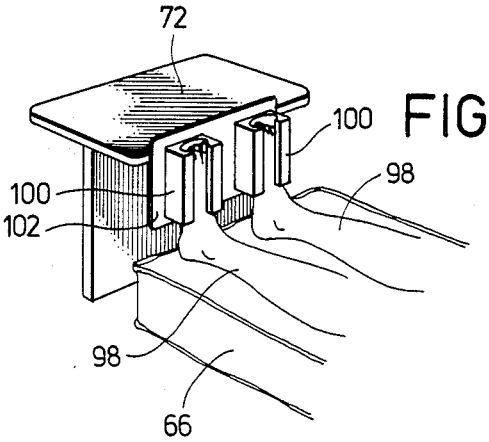
FIG. 15 is a perspective view illustrating the attaching of a foot drop prevention mechanism to the embodiment of FIG. 9.
Figure 16:
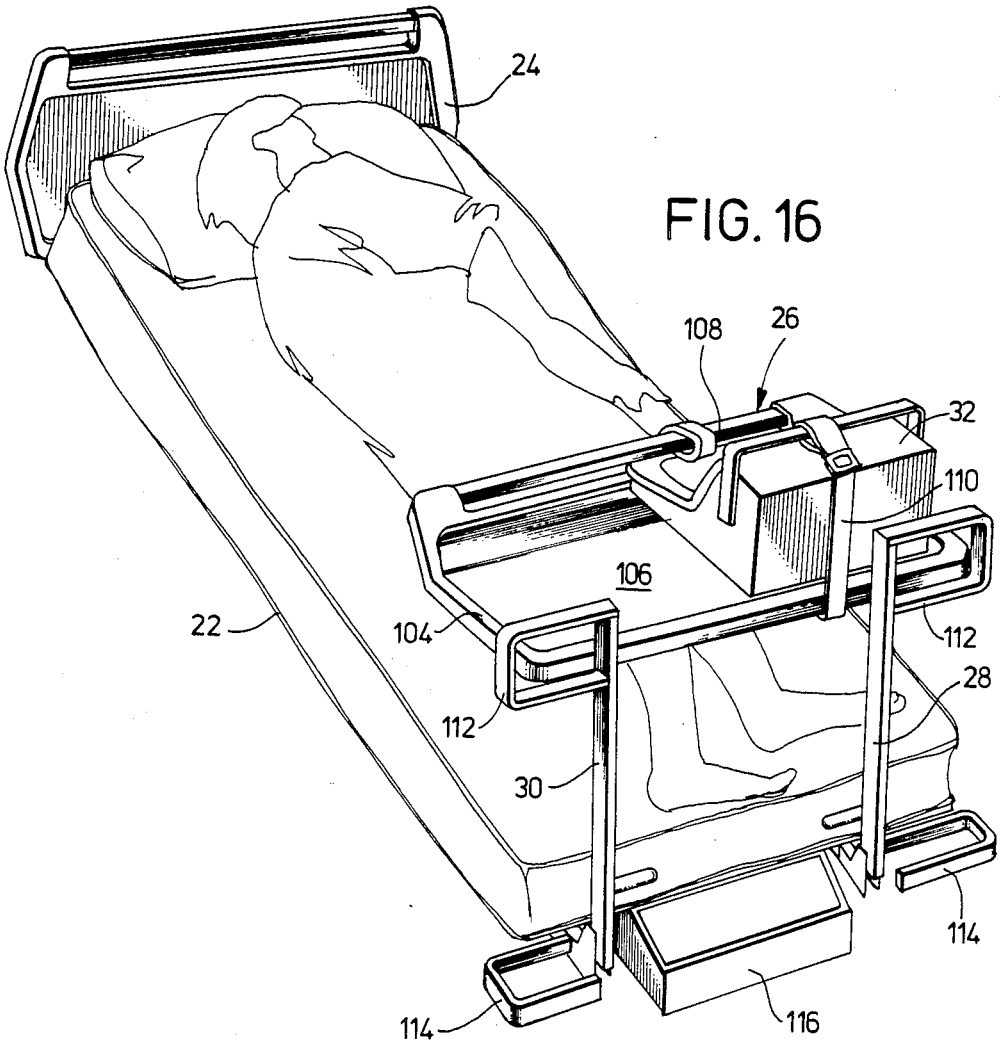
FIG. 16 is a perspective view illustrating a preferred embodiment of the footboard of the present invention.

FIG. 15 illustrates an advantage of using the configuration of the present invention shown in FIGS. 9 through 14. The embodiment of the invention shown in the first drawing figures has the drawback that it is somewhat inflexible as regards its position over the patient bed. That is, it is designed to pivot upward into one fixed position and does not really have intermediate positions over the mattress 66. In the embodiment shown in FIG. 15, the feet 98 of a patient lying on the mattress 66 are captured in foot supports 100 which are mounted on a foot support carrier 102. One problem with patients which are confined to bed for a long period of time is that they develop a symptom known as foot drop. This is due in part to the inability to elevate the feet and to have them in a flexed position to use the ankle muscles. The configuration shown in FIG. 15 is designed to help reduce this condition. In this case, the foot support carrier 102 is attached to the footboard 72 of the bed. The foot supports 100 may be moved relative to the foot support carrier 102 until they are positioned to support the patient's feet 98. Then, the footboard 72 may be positioned back and forth with respect to the mattress 66 until a comfortable position is reached. This requires a somewhat different configuration of the slide plate 76 so that the detent pin 90 does not interfere with positioning the footboard 72 wherever it may be desired. However, this is a relatively minor matter which can be compensated for in the design of the slide plate 76 and the upper slide plate 86. One way to accomplish this would be to simply provide a plurality of detent points along the length of the slide plate 76 to allow a ratcheting sort of motion in the movement of the footboard 72 to allow locking in a plurality of positions intermediate the initial outboard position and the final, fully inboard position. FIGS. 16 illustrates a preferred embodiment of the footboard 26. The footboard 26 is preferable of a generally rectangular shape. The footboard 26 has an upstanding perimeter lip 104 which defines a central recessed portion 106. The recessed portion 106 provides a means to hold equipment 32 in place against sliding. In addition, that portion of the footboard 26 which is the top in its vertical position has an open area defined by a rail 108 which connects the two ends of the perimeter lip 104. The rail 108 preferably is a profile which is compatible with the headwall equipment support system described in U.S. Pat. No. 4,646,21 and assigned to the assignee of the present invention. This allows easy connection of medical devices to the footboard 26. A security strap or straps 110 may also be used to fasten the equipment 32 more securely to the footboard 26. The strap 110 may be of the type using a VELCRO® hook and loop fabric fastener or a buckle type. Also illustrated in FIG. 16 are bumpers 112 and 114. The bumpers 112 are attached to the runners 28 and 30 and provide handles to raise and lower the footboard 26. The bumpers 114 remain fixed in place. The bed 10 may also include a foot control 116 to control various operating functions.

What is claimed is:

1. An improved hospital bed of the type having a patient support surface which includes at least two spaced apart longitudinal, hollow tubular support members tied together by transverse support members to form a platform upon which a patient supporting mattress may rest and a headboard attached to the head end of said hospital bed, wherein said improvement comprises:

a footboard, mounted at the foot portion of said hospital bed; and means for attaching said footboard to said portion such that said footboard is movable from a first position in facing relationship to said headboard to a second position overlying said mattress and substantially perpendicular to said headboard, said attachment means providing a cantilevered support for said foot portion when said footboard is in said second position thereby leaving said longitudinal support members clear of obstructions on both sides of said hospital bed, said means for attaching said footboard including;

a. at least two runners, one runner being slidably mounted for movement in and out of each of said support members;

b. means for latching said runners in said first position in which position said runners are substantially contained inside of said support members;

c. means for removably attaching said footboard to that portion of said runners which extend beyond said support members;

d. means for releasing said latching means and moving said runners out of engagement with said support members to a pre-selected extended position; and e. means for pivoting said runners substantially 90° toward said bed when said runners are extended beyond said support members to thereby position said footboard over said mattress in said second position.

2. The improved hospital bed of claim 1 wherein said footboard includes an upstanding perimeter lip which defines a central recessed portion and an open portion at the top of said footboard, said open portion being defined by a rail which connects upstanding portions of said perimeter lip.

3. The improved hospital bed of claim 2 wherein said footboard further includes means for holding an object in place in said central recessed portion when said footboard is in said second position overlying said mattress.

4. The improved hospital bed of claim 1 which further includes means for extending said hospital bed's length to accomodate taller than average patients.

5. The improved hospital bed of claim 4 wherein said headboard is removably attached to the head portion of said hospital bed by upstanding posts that extend through openings in said headboard and wherein said means for extending said hospital bed's length comprises:

A. A pair of generally "L" shaped stop pins, pivotally mounted adjacent to said mattress and movable between normal position with the foot portion of said "L" parallel to said mattress and an extended position where said foot portion of said "L" extends away from said mattress and generally perpendicular there to, whereby said headboard may be mounted on said stop pins when said runners have been extended to move said footboard away from said mattress, B. A pillow, placed on said headboard and of a thickness sufficient to bring its top surface generally level with the top of said mattress; and C. Means to lock said runners in said extended position and thereby prevent pivot of said footboard into its position overlying said mattress.

6. An improved hospital bed of the type having a patient support surface which includes at least two spaced apart longitudinal support members, each terminating at a foot position of said hospital bed in a generally vertically upstanding post member, tied together by transverse support members to form a platform upon which a patient supporting mattress may rest and a headboard attached to the head end of said hospital bed, wherein said improvement comprises:

a footboard, mounted at the foot portion of said hospital bed;

and means for attaching said footboard to said foot portion such that said footboard is movable from a first position in facing relationship to said headboard to a second position overlying said mattress and substantially perpendicular to said headboard, said attachment means providing a cantilevered support for said footboard from said foot portion when said footboard is in said second position thereby leaving said longitudinal support members clear of obstructions on both sides of said hospital bed, said means for attaching said footboard including;

a. A footboard support column connected to each of said post members and extending vertically beyond said post members;

b. slide means, connected to each of said footboard support columns and to said footboard, for supporting said footboard and for moving said footboard from an initial location outboard of said patient support surface when moved from said first position to said second position overlying said mattress; and c. means, connected to each of said footboard support columns and to said slide means, for moving said slide means from a location substantially facing said footboard support columns to a position at substantially 90° thereto and in a direction away from said hospital bed.

7. The improved hospital bed of claim 6 wherein said footboard includes an upstanding perimeter lip which defines a central recess portion and an open portion at the top of said footboard, said open portion being defined by a rail which connects upstanding portions of said perimeter lip.

8. The improved hospital bed of claim 7 wherein said footboard further includes means for holding an object in place in said central recessed portion when said footboard is in said second position overlying said mattress.

* * * * *